US010054378B2

(12) United States Patent
Pawlowski

(10) Patent No.: US 10,054,378 B2
(45) Date of Patent: Aug. 21, 2018

(54) FIREARM AND FIREARM BUFFER ASSEMBLY

(71) Applicant: Casimir Pawlowski, Enfield, CT (US)

(72) Inventor: Casimir Pawlowski, Enfield, CT (US)

(73) Assignee: TCC Solutions, Suffield, CT (US)

( * ) Notice: Subject to any disclaimer, the term of this patent is extended or adjusted under 35 U.S.C. 154(b) by 0 days.

(21) Appl. No.: 15/290,808

(22) Filed: Oct. 11, 2016

(65) Prior Publication Data

US 2017/0299295 A1 Oct. 19, 2017

Related U.S. Application Data

(60) Provisional application No. 62/239,602, filed on Oct. 9, 2015.

(51) Int. Cl.
*F41A 3/84* (2006.01)

(52) U.S. Cl.
CPC ..... *F41A 3/84* (2013.01)

(58) Field of Classification Search
CPC .... F41A 21/00; F41A 3/78; F41A 3/80; F41A 3/82; F41A 3/84
USPC ..... 42/1.06; 89/177, 198, 199
See application file for complete search history.

(56) References Cited

U.S. PATENT DOCUMENTS 3,366,011 A * 1/1968 Sturtevant ..... F41A 3/70 89/198
6,829,974 B1 * 12/2004 Gwinn, Jr. ..... F41A 3/84 89/130
7,131,367 B1 * 11/2006 Boerschig ..... F41A 3/94 42/1.06
7,478,495 B1 * 1/2009 Alzamora ..... F41C 23/06 42/74
8,375,616 B2 * 2/2013 Gomez ..... F41A 3/26 42/16
8,468,729 B1 * 6/2013 Sylvester ..... F41A 3/84 42/1.01
8,746,125 B2 * 6/2014 Gomez ..... F41A 3/26 89/191.01
9,341,437 B1 * 5/2016 Huang ..... F41A 3/84
9,395,148 B1 * 7/2016 Huang ..... F41C 23/06
9,739,566 B2 * 8/2017 Huang ..... F41C 23/06
2006/0236853 A1 * 10/2006 Boersching ..... F41A 3/70 89/198
2006/0254414 A1 * 11/2006 Kuczynko ..... F41A 3/84 89/198
2010/0251587 A1 * 10/2010 Kincel ..... F41A 3/84 42/1.06
2010/0251588 A1 * 10/2010 Kincel ..... F41A 3/84 42/1.06

(Continued)

*Primary Examiner* — Jonathan C Weber
(74) *Attorney, Agent, or Firm* — Perman & Green, LLP

(57) ABSTRACT

A black rifle including a receiver with a bolt carrier movably located therein, a receiver extension tube connected to the receiver, the receiver extension tube including an aperture disposed at an end of the receiver extension tube, and a buffer assembly having an interface surface configured to interface with bolt carrier and being configured to reciprocate through the aperture within the receiver extension tube, the buffer assembly including an open fluid passage, through the buffer assembly, that is sized and shaped for enabling movement of the bolt carrier relative to the receiver and effect automatic or semi-automatic fire when the receiver extension is at least partially filled with water.

20 Claims, 6 Drawing Sheets

(56) References Cited

U.S. PATENT DOCUMENTS

| | | | | |
|---|---|---|---|---|
| 2012/0137869 | A1* | 6/2012 | Gomez | F41A 3/26 89/125 |
| 2013/0152443 | A1* | 6/2013 | Gomez | F41A 3/26 42/16 |
| 2014/0059909 | A1* | 3/2014 | Caudle | F41A 3/84 42/1.06 |
| 2014/0075798 | A1* | 3/2014 | Kincel | F41A 3/84 42/1.06 |

* cited by examiner (Section T-T)

FIREARM AND FIREARM BUFFER ASSEMBLY

CROSS REFERENCE TO RELATED APPLICATIONS

This application is a non-provisional of and claims the benefit of U.S. provisional patent application No. 62/239,602 filed on Oct. 9, 2015 the disclosure of which is incorporated herein by reference in its entirety.

BACKGROUND

1. Field

The aspects of the disclosed embodiment described herein relate to automatic or semi-automatic firearms and, more particularly, to automatic and semi-automatic firearms employable in "over the beach" operations.

2. Brief Description of Related Developments

The AR15/M16 family of weapons and their derivatives including the M-4 and indirect gas operated versions, have been in use by the military, law enforcement and civilian population for many years. In law enforcement and military applications in particular, the AR15/M16 family of weapons may be deployed from or in a marine (salt or fresh water) environment where the weapon may be submerged or subjected to water splashing on or entering the weapon. In such cases it may be necessary to fire the weapon substantially immediately upon removal of the weapon from the water. This type of weapon deployment is referred to as an "over the beach operation" which is becoming increasingly desirable with military and law enforcement personnel.

In an effort to enable over the beach capability of the AR15/M16 family of weapons and their derivatives several modifications to the weapon have been attempted. One example, of providing over the beach capability is through the use of specially designed (i.e. not in a stock configuration) bolt carriers and receiver extension tubes. The specially designed bolt carriers generally include water-draining cots at the rear of the bolt carrier which increases the manufacturing cost of the weapon. The specially designed receiver extension tubes include drainage holes provided on the underside and at the rear of the receiver extension tube. The drainage holes in the receiver extension tube also increase manufacturing costs of the weapon as these drainage holes are not included in the standard base configuration of the weapon. Other attempts to provide over the beach capability include providing a selector at the end of the receiver extension tube that allows the user of the weapon to select an aperture size for allowing water drainage out of the receiver extension tube. This variable drainage aperture selector also adds complexity and cost to the weapon.

It would be advantageous to have a water/fluid drainage capability that may be retrofitted to existing weapons in their stock configuration (e.g. with conventional stock configuration bolt carriers and stock configuration receiver extension tubes) without breaking down the weapon beyond field stripping.

BRIEF DESCRIPTION OF THE DRAWINGS

The foregoing aspects and other features of the disclosed embodiment are explained in the following description, taken in connection with the accompanying drawings, wherein.

DETAILED DESCRIPTION

Figure 1:
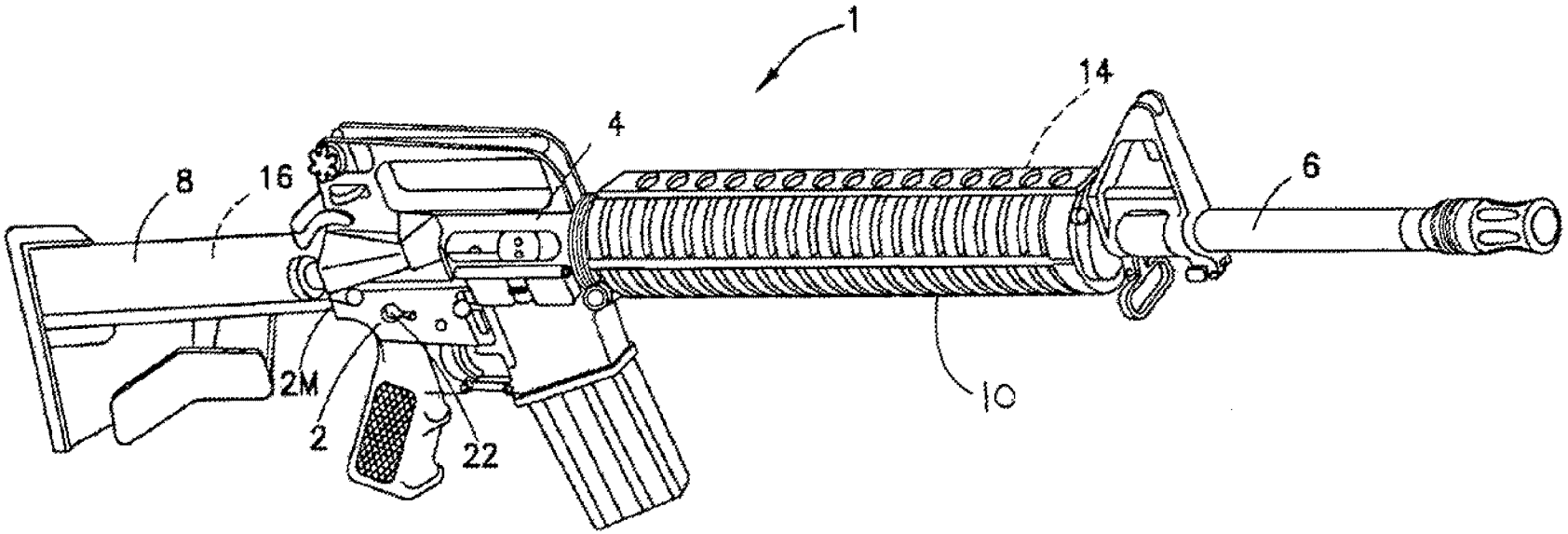
FIG. 1 is a schematic illustration of a firearm including aspects of the disclosed embodiment.
Figure 2:
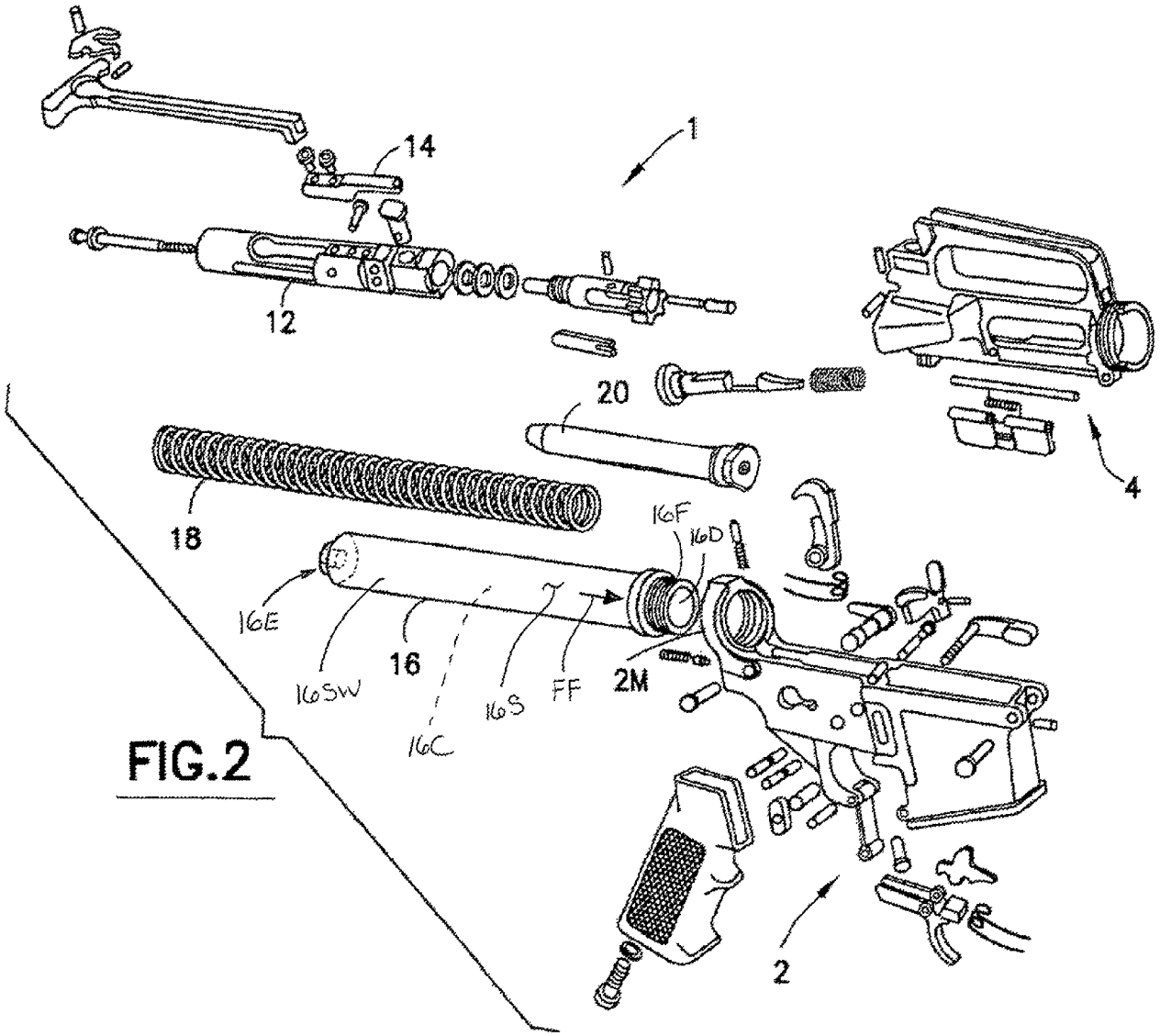
FIG. 2 is an exploded perspective view of portions of the firearm illustrated in FIG. 1.

Referring to FIGS. 1 and 2, there is respectively shown a perspective view of a firearm 1 including aspects of the disclosed embodiment, and an expanded view of portions of the firearm 1. In one aspect, the firearm 1 is illustrated as generally having a black rifle configuration. The black rifle configuration being the family of rifles developed by Eugene Stoner, for example, such as an M4, M15/M16 type automatic (or semiautomatic or selective fire) firearm configuration having calibers ranging from 0.177 inches to 0.5 inches (e.g. 50 cal.). However, the features of the aspects of the disclosed embodiment, as will be described below, are equally applicable to any desired type of automatic, semi-automatic and/or selective fire firearm having any suitable caliber. Firearm 1 may have operational features such as described in U.S. Pat. Nos. 5,726,377, 5,760,328, 4,658,702 and 4,433,610, and U.S. patent application Ser. No. 10/836,443, filed Apr. 30, 2004 and U.S. Provisional Patent Application Ser. No. 60/564,895, filed Apr. 23, 2004, all of which are hereby incorporated by reference herein in their entirety.

As seen in FIGS. 1 and 2, the firearm 1 is illustrated as an M-4 or M-16 type automatic firearm (or corresponding commercially available variant), for example purposes only, having a stock configuration where the stock configuration is standard base configuration of the firearm. For example, in one aspect, at least the receiver extension tube 16 and bolt carrier 12 (which are described herein) are not modified from the standard base configuration. The firearm 1 generally has a lower receiver 2, an upper receiver 4, a barrel 6 and butt stock 8. The upper receiver 4 is connected to the lower receiver 2. The barrel 6, which is covered by a handguard 10, is connected to the upper receiver 4. The upper receiver 4 holds the bolt carrier 12 that is operated by a direct gas impingement or indirect gas operating system 14 powered by exhaust gases generated during firing of the firearm 1. As seen in FIG. 2, the lower receiver 2 may have a mounting bracket 2M for mounting a receiver extension tube 16. The receiver extension tube 16 may be located within the buttstock 8 and may provide support to the buttstock 8. In conventional M-4 type firearms, the stock configuration receiver extension tube 16 is hollow and provides a housing for the action spring 18 and buffer assembly 20. The buffer assembly 20 is positioned by the action spring 18 against the bolt carrier 12, to bias the bolt carrier 12 to its closed position. Hence, as may be realized, operation of the bolt carrier 1 (i.e. sliding back) inside the upper receiver under impetus from the operating system, impinges on the buffer assembly 20 thereby moving the buffer assembly 20 back inside the receiver extension 16 and compressing the action spring 18. As will be described in greater detail below, the buffer assembly 20 is configured to allow the firearm 1 to be operated substantially upon removal of the firearm 1 from water immersion using, for example, a conventional stock configuration bolt carrier 12 and a stock configuration receiver extension tube 16. The firearm 1 and its sections is/are merely exemplary, and in other aspects the firearm 30 may have other sections, portions or systems.

Still referring to FIG. 2, in a stock configuration the receiver extension tube 16 has a hollow generally cylindrical shape having a closed side walls forming a stock support 16S, an open front portion 16F and a closed rear portion 16E (which may generally include an aperture in which a fastener is inserted to hold the stock on the receiver extension tube). In alternate embodiments, the receiver extension tube may have any other desired shape. The front portion 16F of the stock configuration receiver extension tube 16 includes a suitable interface for coupling or otherwise interfacing the stock configuration receiver extension tube 16 to the mounting bracket 2M of the lower receiver 2 of firearm 1. For example, the front portion 16F of the stock configuration receiver extension may incorporate a mechanical coupling, such as a threaded section similar to the threaded section at the front 16F of the stock configuration receiver extension tube 16 shown in FIG. 2. In other aspects, the coupling of the receiver extension tube 16 to the mounting bracket 2M may have any other desirable interface. The stock configuration receiver extension tube 16, such as conventional receiver extension tubes, also includes an aperture 16D that extends from the closed rear 16E, along the length of the stock configuration receiver extension tube 16 to form the open front 16F of the stock configuration receiver extension tube 16, which when employed with the aspects of the disclosed embodiment allow(s) fluids to be expelled or drained from the firearm 1 as will be described in greater detail below. The stock configuration receiver extension tube 16 may also have a buttstock support 16S, formed by the closed (e.g. no holes therein) side wall 16SW, that provides a mount or attachment for the buttstock 8 to the stock configuration receiver extension tube 16, and hence, facilitates mounting of the buttstock 8 to the firearm 1. The buttstock support 16S may have any other suitable shape and any suitable orientation.

Figure 3B:
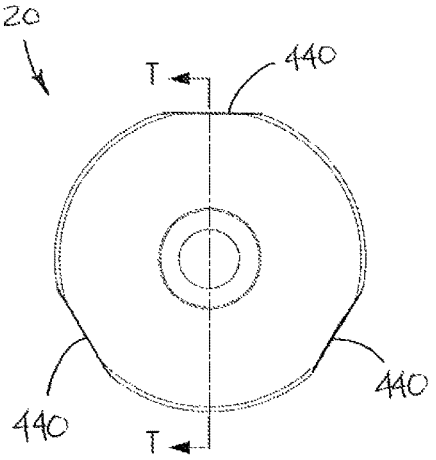
FIGS. 3A-3C are schematic illustrations of a buffer assembly in accordance with aspects of the disclosed embodiment.
Figure 3C:
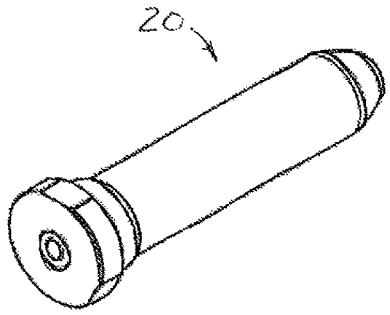
Figure 3A:
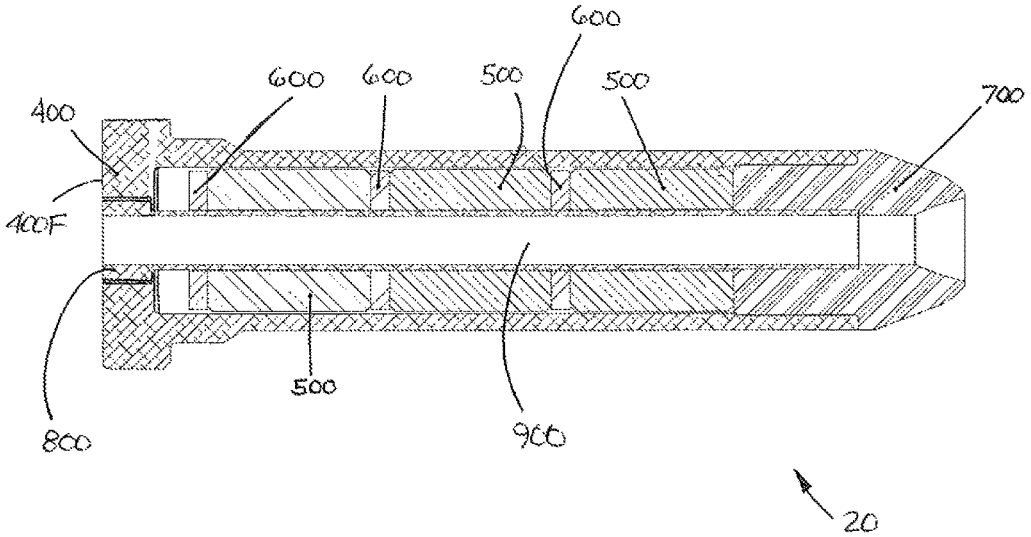
Figure 4:
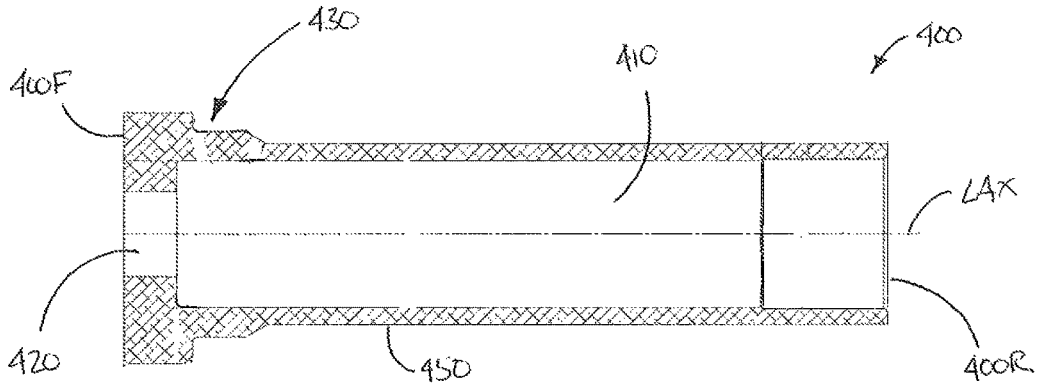
FIG. 4 is a schematic illustration of a portion of the buffer assembly in accordance with aspects of the disclosed embodiment.
Figure 5A:
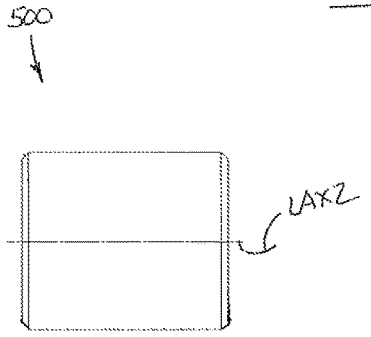
FIGS. 5A and 5B are schematic illustrations of a portion of the buffer assembly in accordance with aspects of the disclosed embodiment.
Figure 5B:
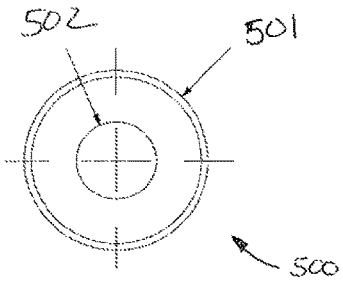

The generally hollow cylindrical shape of the stock configuration receiver extension tube 16 forms an internal cavity 16C that forms a guide for the reciprocating movement of the buffer assembly 20 and action spring 18 within the stock configuration receiver extension tube 16. Referring to FIGS. 3A-3C, the buffer assembly 20 includes a body 400, a bumper 700, at least one weight 500, at least one elastomeric buffer 600 and a holding pin 800. Referring also to FIG. 4, the body 400 has a longitudinal axis LAX and includes a generally hollow cylindrical shape forming a cavity 410 and having a front 400F that interfaces with the bolt carrier 12 and a rear 400R (that is longitudinally displaced from the front 400F) into which the bumper 700 is at least partially inserted. In one aspect, the front 400F includes an aperture 420 that is in fluid communication with the cavity 410. In one aspect, the aperture 420 is a threaded aperture configured for the retention of the holding pin 800 in the buffer assembly 20, while in other aspects, the holding pin 800 is retained by the aperture 420 in any suitable manner such as by an interference fit or other mechanical or chemical retention (e.g. welding, braising, bonding, retainer clips, etc.) The aperture 420 is in one aspect disposed along the longitudinal axis LAX while in other aspects the aperture is offset from the longitudinal axis LAX. In one aspect, the front 400F includes a circumferential shoulder portion 430 that interfaces with and provides a stopping/retention surface for the action spring 18 as well as the bolt carrier 12. The circumference of the shoulder portion 430 is such that there is a snug slip fit between the action spring 18 and the body 400. In other aspects, there is any suitable amount of clearance between the shoulder portion 430 and the action spring 18. In one aspect, the body 400 includes a recessed portion 450 that has a smaller circumference or diameter than the shoulder portion 430 to allow relative movement between the action spring 18 and the body 400 to allow for compression of the action spring 18 and to prevent binding of the action spring 18 during operation of the firearm 1.

As may be realized, the front 400F circumferentially interfaces with the internal cavity 16C (formed by the hollow cylindrical shape) of the stock configuration receiver extension tube 16 and acts to guide the buffer assembly 400 along a length of the receiver extension tube 16. In one aspect, to allow reciprocating movement of the buffer assembly 20 within the stock configuration receiver extension tube 16, the body 400 also includes one or more flats 440 around the periphery of the front 400F. In other aspects, any suitable relief such as grooves or scallops is disposed on the periphery of the front 400F. The one or more flats 400 may be substantially similar to the flats 440 found on a stock buffer for a black rifle.

In one aspect, the body 400 is constructed of any suitable material such as aluminum, steel or composites. The body 400 is, in one aspect, coated with any suitable coating(s) to effect a predetermined corrosion resistance. In one aspect, the coating(s) also effect a predetermined lubricity between the body 400 and the stock configuration receiver extension tube 16. In other aspects, the body 400 is uncoated.

Referring to FIGS. 3A, 4, 5A and 5B, one or more weights 500 may be disposed within the cavity 410. The weights 500 are constructed of any suitable material, such as tungsten or steel, that effects, when present within the body 400, controlling the cycling rate (e.g. rate of fire) of the firearm 1. For example, increasing the number of weights slows the cycling rate of the firearm 1 while decreasing the number of rates increases the cycling rate of the firearm 1. Each weight 500 includes a cylindrical body 501 having an aperture or hole 502 extending through a longitudinal axis LAX2 of the body 501. In other aspects, the aperture 502 is offset from the longitudinal axis LAX2. The aperture 502 is generally aligned with the aperture 420 of the body 400 so that the holding pin 800 extends through the apertures 502, 420 of the body 400 and each of the weights 500. In one aspect, the body 501 of each weight 500 has any suitable cross-sectional shape that substantially matches or corresponds to a cross-sectional shape of the cavity 410. The body 501 of each weight 500 also has any suitable length to allow one or more weights 500 to be placed within the cavity 410 of the body 400. Each of the weights 500 is, in one aspect, coated with any suitable coating to provide a predetermined lubricity and/or to provide a predetermined corrosion resistance. In other aspects, the weights 500 are uncoated. In one aspect, each weight 500 has a predetermined weight which when disposed within the body 400 provides the buffer assembly 20 with a weight of about 98 grams to about 136 grams. In other aspects, the buffer assembly 20 has a weight greater than about 136 grams and less than about 98 grams.

Figure 6A:
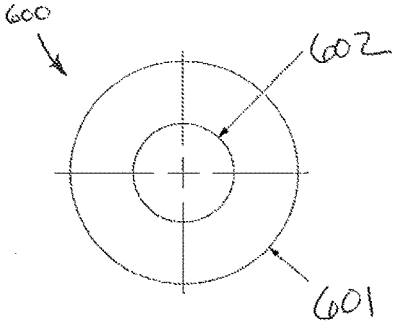
FIGS. 6A and 6B are schematic illustrations of a portion of the buffer assembly in accordance with aspects of the disclosed embodiment.
Figure 6B:
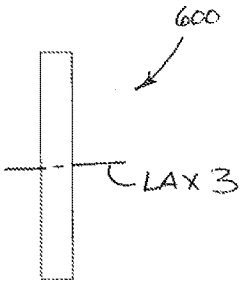

In one aspect, referring to FIGS. 6A and 6B, the buffer assembly 20 includes one or more elastomeric members or buffers 600. The elastomeric buffers 600 are disposed between each of the weights 500 and between the weights and the front 400F of the body 400. The elastomeric buffers 600 are constructed of any suitable elastomer to provide a cushion between each of the weights 500 and between the front 400F and the weights 500 during cycling of the firearm 1. In one aspect the elastomer buffers 600 are constructed of any suitable synthetic rubber, vulcanized rubber or any other suitable elastomer that does not initiate corrosion with the materials in comes into contact with (e.g. the weights 500, the body 400, the holding pin 800, etc.). Each of the elastomeric buffers 600 has a body 601 with an aperture 602 extending there through along a longitudinal axis LAX3 of the body 601. The body 601 has a cross sectional shape that corresponds with the cross sectional shape of one or more of the weights 500 and the cavity 410. The body 601 of the elastomeric buffers 600 also has any suitable length or thickness that effects cushioning the weights 500 and/or front 400F where the thickness may, in one aspect, depend on the elastomeric material.

In one aspect, referring to FIGS. 3A, 7A, 7B and 9, the buffer assembly includes a bumper 700. The bumper is, in one aspect, a monolithic member having a body interface portion 710 and a stopper or buffer portion 720 that extend along a longitudinal axis LAX4 of the bumper 700. In one aspect, the bumper 700 is constructed of any suitable elastomeric or polymeric material that effects compression of the bumper 700 as it contacts an inner surface 16ES the end 16E of the receiver extension tube 16 of the firearm 1 (FIG. 2) during operation of the firearm 1. In one aspect, the body 400 does not extend over the buffer portion 720 to allow compression of the buffer portion 720 as will be described below. In one aspect the compression of the bumper 700 is facilitated by, for example, a spring load of the action spring 18, which in one aspect has a spring load of about 4 pounds when the firearm 1 is in battery (e.g. when the bolt is closed and the firearm is ready to fire) and a spring load of about 14 pounds at a maximum deflection of the action spring 18. In other aspects, the action spring 18 may have any suitable spring load and/or spring rate.

Figure 7A:
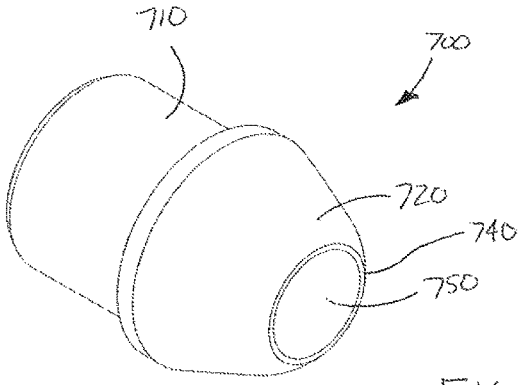
FIGS. 7A and 7B are schematic illustrations of a portion of the buffer assembly in accordance with aspects of the disclosed embodiment.
Figure 7B:
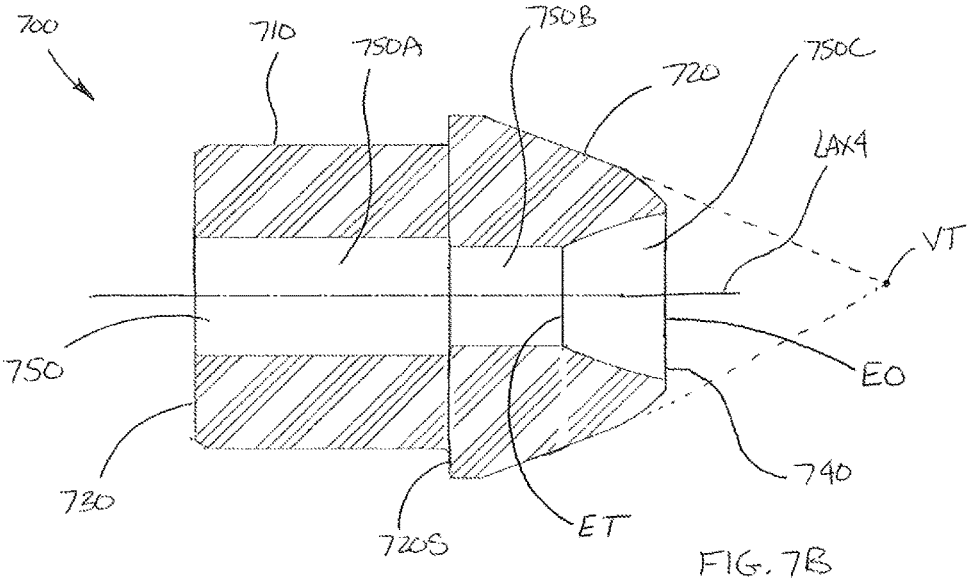
Figure 8:
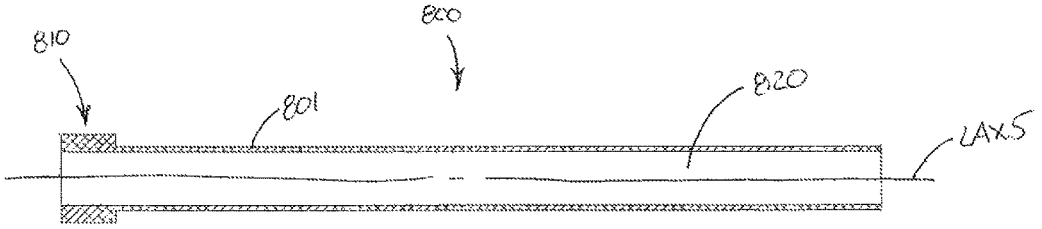
FIG. 8 is a schematic illustration of a portion of the buffer assembly in accordance with aspects of the disclosed embodiment.

The body interface portion 710 includes a generally cylindrical cross section that is inserted into and retained by the rear 400R of the body 400. The body interface portion 710 has any suitable length for extending any suitable distance into the cavity 410. The body interface portion 710 includes a weight interface surface 730 that operates with at least one elastomeric buffer 600 to cushion one or more weights 500 within the cavity 410 during operation of the firearm 1. The stopper portion 720 of the bumper 700 includes a shoulder 720S that radially extends from the body interface portion 710. The shoulder interfaces with the rear 400R of the body 400 to prevent the stopper portion 710 from entering the cavity 410 (and to prevent the body 400 from extending over the stopper portion 720). In one aspect, the stopper portion 720 has a truncated conical shape having a base adjacent the body interface portion 710 (e.g. at the shoulder 720S) and a vertex VT opposite the base. As can be seen in FIG. 7B the tip of the conical stopper portion 720 is truncated to form a bumper surface 740 that interfaces with, for example, the end 16E of the receiver extension tube 16 (see FIG. 2) to stop the rearward movement (e.g. away from the upper and lower receivers 2, 4) of the buffer assembly 20 and the stock configuration bolt carrier 12.

In one aspect, the bumper 700 includes an aperture 750 that extends along the longitudinal axis LAX4 through body interface portion 710 and the stopper portion 720. In one aspect, the aperture 750 is disposed in the bumper 700 so as to be substantially aligned with the aperture 420 of the body 400 (see FIG. 4), the aperture 502 of the weight (s) 500 (see FIGS. 5A-5B) and the aperture 602 of the elastomeric buffer(s) 600 (see FIGS. 6A-6B) such that the holding pin 800 extends through at least a portion of the apertures 420, 502, 602, 750. For example, the aperture 750 includes one or more portions 750A, 750B, 750C where the portion 750A is shaped and sized so that the holding pin 800 is inserted into and extends into the portion 750A by any suitable distance. As will be described in greater detail below the holding pin 800 and the aperture 750 form a fluid passage that allows fluid to pass through the buffer assembly 20 and out of the front 16F of the receiver extension tube 16 through the aperture 16D of the receiver extension tube 16 (FIG. 2). In one aspect, the portion 750B is in fluid communication with the portion 750A and has a size and shape substantially similar an internal passage 820 of the holding pin 800 (e.g. in one aspect, the internal passage 820 and the portion 750B have substantially the same inner diameter/cross section). The portion 750C is in fluid communication with the portion 750B (and portion 750A) and includes a funneling opening that extends from the portion 750B to its widest at the bumper surface 740. In one aspect, the funneling opening may be a frustoparabolic opening, a conical opening, a rounded opening, or any other suitable opening having any suitable shape that is tapered between an entry opening EO and exit opening ET (FIG. 7B) and configured (e.g. sized and shaped) to funnel or otherwise channel fluids, located between the buffer assembly and the closed rear 16E of the stock configuration receiver extension tube 16 (e.g. water head), into the passage 900 of the buffer assembly 20. The funneling shape funnels water through the aperture 16D of the stock configuration receiver extension tube 16 when water head is present in the stock configuration receiver extension tube 16.

Figure 9:
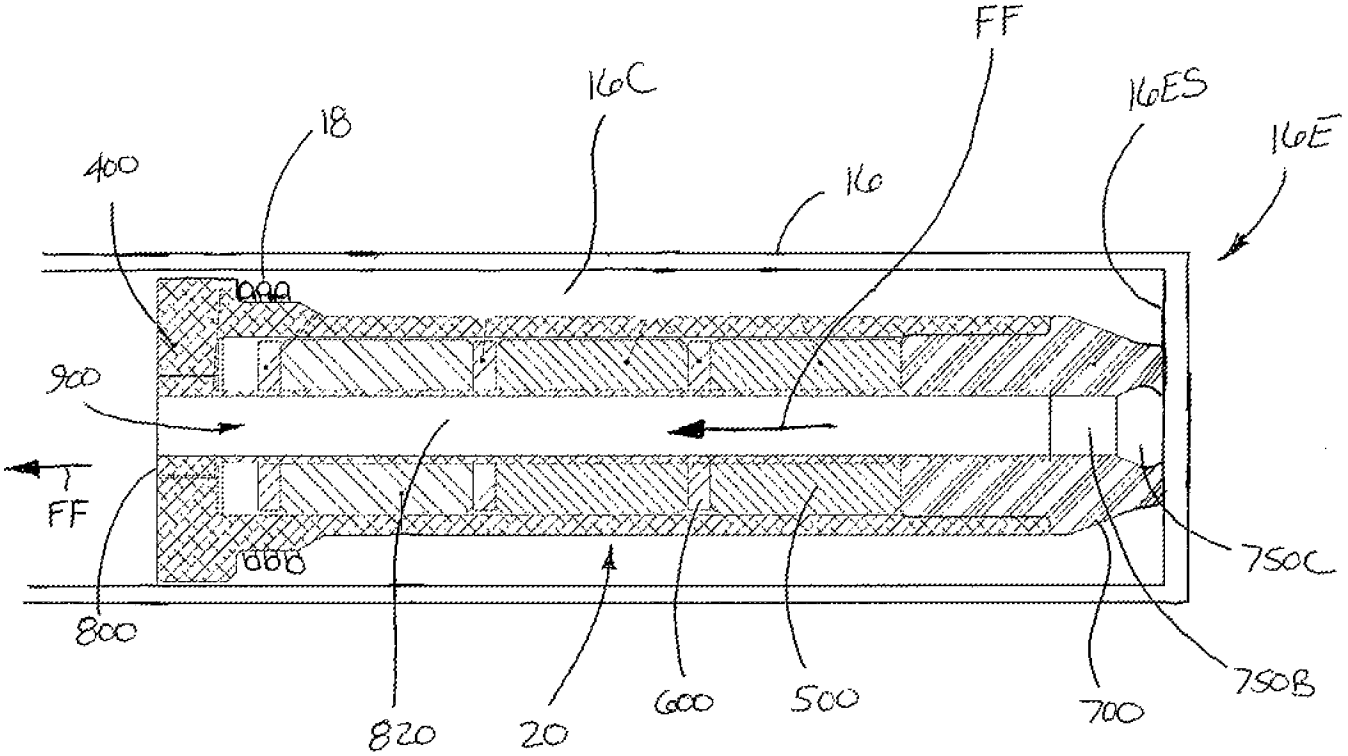
FIG. 9 is a schematic illustration of a portion of the firearm of FIG. 1 in accordance with aspects of the disclosed embodiment.

Referring to FIGS. 3A and 9, in one aspect the holding pin 800 is a generally cylindrical member having a body 801 that extends along longitudinal axis LAX5. The body 801 includes a retention portion 810 disposed at one end of the body 801 that is configured to interface with the aperture 420 of the body 400 (FIG. 4) as described above. The holding pin 800 has any suitable length so as to extend from the front 400F of the body 400 into the portion 750A of the aperture 750 in the bumper 700 (FIG. 7B). As described above, the holding pin 800 includes aperture 820 that extends along the longitudinal axis LAX5. The aperture 820 has any suitable cross-sectional shape and size to allow fluid flow through the buffer assembly 20. In one aspect, the aperture 820 has a diameter of about 0.195 inches or about 0.2 inches to about 159 inches or 0.15 inches. In one aspect, the aperture has a diameter of about 0.187 inches.

As can be seen in FIGS. 1, 2 and 9, the aperture of the holding pin 800 and the aperture 750 of the bumper 700 form a fluid passage 900 through the buffer assembly 20. The fluid passage 900 is generally open to and in fluid communication with the aperture 16D of the stock configuration receiver extension tube 16. During operation of the firearm 1, fluid such as water may be present within the action such as when the firearm 1 is submerged or subjected to water splashing on or entering the firearm 1. Upon removal of the firearm 1 from the water, any water within the action may pass from the stock configuration receiver extension tube 16 through the passage 900 in the buffer assembly 20 and out of the aperture 16B at the front 16F of the stock configuration receiver extension tube 16 allowing over the beach operation of the firearm 1. When the firearm 1 is operated the stock configuration bolt carrier 12 pushes the buffer assembly 20 rearward towards the surface 16ES of the stock configuration receiver extension tube 16. This rearward movement/pumping action of the buffer assembly 20 pushes water within the stock configuration receiver extension tube 16 towards the rear 16E of the stock configuration receiver extension tube 16 and into the passage 900 and through the buffer assembly 20 for evacuation from the stock configuration receiver extension tube 16. The water present behind the stock configuration bolt carrier 12 (e.g. within the stock configuration receiver extension tube) is channeled through the funneling opening of the portion 750C of the bumper 700 (e.g. the funneling opening directs the water into the passage 900) by the pumping action of the buffer assembly 20 where the water flows through the passage 900 of the buffer assembly 20 in the direction of arrow FF and is directed out of the aperture 16D. In one aspect, the funneling opening of the portion 750C of the bumper 700 compresses against the surface 16ES of the stock configuration receiver extension tube 16 to further pump the water through the passage in the direction FF for evacuation of the water out of the aperture 16D. In other aspects, the buffer assembly 20 allows for draining of water from the receiver extension tube through the passage 900 when the firearm 1 is in battery (e.g. when the buffer assembly 20 and bolt carrier 12 are in a forward unfired position). In one aspect the water exiting the aperture 16D may exit the firearm through one or more of an ejection port of the upper receiver 4, a magazine well of the lower receiver 2, the barrel 6 or any seams between the upper receiver 4 and the lower receiver 2.

In accordance with one or more aspects of the present disclosure, a black rifle comprises a receiver with a bolt carrier movably located therein;

a receiver extension tube connected to the receiver, the receiver extension tube including an aperture disposed at an end of the receiver extension tube; and a buffer assembly having an interface surface configured to interface with bolt carrier and being configured to reciprocate through the aperture within the receiver extension tube, the buffer assembly including an open fluid passage, through the buffer assembly, that is sized and shaped for enabling movement of the bolt carrier relative to the receiver and effect automatic or semi-automatic fire when the receiver extension is at least partially filled with water.

In accordance with one or more aspects of the disclosed embodiment, the open fluid passage extends along a longitudinal axis of the buffer assembly.

In accordance with one or more aspects of the disclosed embodiment, reciprocation of the buffer assembly causes a pumping action effecting evacuation of water in one or more of the receiver and the receiver extension tube through the buffer assembly.

In accordance with one or more aspects of the disclosed embodiment, the buffer assembly includes a compressible bumper configured to interface with an internal surface of the receiver extension tube to effect stopping movement of the bolt carrier away from the receiver.

In accordance with one or more aspects of the disclosed embodiment, the buffer assembly includes a compressible bumper having an aperture that forms part of the open fluid passage.

In accordance with one or more aspects of the disclosed embodiment a portion of the aperture of the compressible bumper includes a funneling cross-section which funnels water through the aperture of the receiver extension tube when water head is present in the receiver extension tube.

In accordance with one or more aspects of the disclosed embodiment the funneling cross-section is a frustoparabolic cross-section.

In accordance with one or more aspects of the disclosed embodiment, the buffer assembly includes one or more weights for effecting a predetermined cycling rate of the black rifle.

In accordance with one or more aspects of the disclosed embodiment each weight includes an aperture through which the open fluid passage extends.

In accordance with one or more aspects, of the disclosed embodiment, the buffer assembly includes one or more buffer members disposed between the one or more weights.

In accordance with one or more aspects of the disclosed embodiment each buffer member includes an aperture through which the open fluid passage extends.

In accordance with one or more aspects of the disclosed embodiment, the buffer assembly includes a holding pin that includes an aperture that forms part of the open fluid passage that extends from the interface surface through the buffer assembly.

In accordance with one or more aspects of the disclosed embodiment the buffer assembly includes a body having a longitudinal axis and the holding pin is coupled to the body to extend along the longitudinal axis.

In accordance with one or more aspects of the disclosed embodiment a black rifle buffer assembly comprises a buffer body configured having an bolt carrier interface surface and an action spring interface surface, the buffer body having a longitudinal axis;

a holding pin coupled to the buffer body and extending along the longitudinal axis, the holding pin including a holding pin aperture that extends through the bolt carrier interface surface; and a bumper coupled to an end of the buffer body opposite the bolt carrier interface, the bumper including a bumper aperture in communication with the holding pin aperture where the bumper aperture and the holding pin aperture form a fluid passage configured to direct water through the black rifle buffer assembly.

In accordance with one or more aspects of the disclosed embodiment, the bumper is configured to interface with an internal surface of a receiver extension tube to effect stopping movement of the bolt carrier away from the receiver.

In accordance with one or more aspects of the disclosed embodiment, the bumper is compressible.

In accordance with one or more aspects of the disclosed embodiment the bumper aperture includes a frustoparabolic cross-section which when compressed directs water through an aperture of a receiver extension tube.

In accordance with one or more aspects of the disclosed embodiment, the black rifle buffer assembly includes one or more weights for effecting a predetermined cycling rate of a black rifle.

In accordance with one or more aspects of the disclosed embodiment each weight includes an aperture through which the fluid passage extends.

In accordance with one or more aspects, of the disclosed embodiment, the black rifle buffer assembly includes one or more buffer members disposed between the one or more weights.

In accordance with one or more aspects of the disclosed embodiment each buffer member includes an aperture through which the fluid passage extends.

In accordance with one or more aspects of the present disclosure, a black rifle comprises a receiver with a bolt carrier movably located therein;

a stock configuration receiver extension tube connected to the receiver, the stock configuration receiver extension tube including a stock configuration aperture disposed at an end of the stock configuration receiver extension tube; and a buffer assembly having an interface surface configured to interface with a bolt carrier and being configured to reciprocate through the stock configuration aperture within the stock configuration receiver extension tube, the buffer assembly including an open fluid passage, through the buffer assembly, that is sized and shaped for channeling water and draining the stock configuration receiver extension tube through the stock configuration aperture of the stock configuration receiver extension tube enabling movement of the bolt carrier relative to the receiver and effect automatic or semi-automatic fire when the stock configuration receiver extension is at least partially filled with water.

In accordance with one or more aspects of the disclosed embodiment, the open fluid passage extends along a longitudinal axis of the buffer assembly.

In accordance with one or more aspects of the disclosed embodiment, reciprocation of the buffer assembly causes a pumping action effecting evacuation of water in one or more of the receiver and the stock configuration receiver extension tube through the buffer assembly.

In accordance with one or more aspects of the disclosed embodiment, the buffer assembly includes a compressible bumper configured to interface with an internal surface of the stock configuration receiver extension tube to effect stopping movement of the bolt carrier away from the receiver.

In accordance with one or more aspects of the disclosed embodiment, the buffer assembly includes a compressible bumper having an aperture that forms part of the open fluid passage.

In accordance with one or more aspects of the disclosed embodiment a portion of the aperture of the compressible bumper includes a funneling cross-section which funnels water through the stock configuration aperture of the stock configuration receiver extension tube when water head is present in the stock configuration receiver extension tube.

In accordance with one or more aspects of the disclosed embodiment the funneling cross-section is a frustoparabolic cross-section.

In accordance with one or more aspects of the disclosed embodiment, the buffer assembly includes one or more weights for effecting a predetermined cycling rate of the black rifle.

In accordance with one or more aspects of the disclosed embodiment each weight includes an aperture through which the open fluid passage extends.

In accordance with one or more aspects, of the disclosed embodiment, the buffer assembly includes one or more buffer members disposed between the one or more weights.

In accordance with one or more aspects of the disclosed embodiment each buffer member includes an aperture through which the open fluid passage extends.

In accordance with one or more aspects of the disclosed embodiment, the buffer assembly includes a holding pin that includes an aperture that forms part of the open fluid passage that extends from the interface surface through the buffer assembly.

In accordance with one or more aspects of the disclosed embodiment the buffer assembly includes a body having a longitudinal axis and the holding pin is coupled to the body to extend along the longitudinal axis.

In accordance with one or more aspects of the present disclosure, a black rifle comprises a stock configuration receiver with a stock configuration bolt carrier movably located therein;

a stock configuration receiver extension tube connected to the stock configuration receiver, the stock configuration receiver extension tube including a stock configuration aperture disposed at an end of the stock configuration receiver extension tube; and a buffer assembly having an interface surface configured to interface with a bolt carrier and being configured to reciprocate through the stock configuration aperture within the stock configuration receiver extension tube, the buffer assembly including an open fluid passage, through the buffer assembly, that is sized and shaped for channeling water and draining the stock configuration receiver extension tube through the stock configuration aperture of the stock configuration receiver extension tube enabling movement of the stock configuration bolt carrier relative to the stock configuration receiver and effect automatic or semi-automatic fire when the stock configuration receiver extension is at least partially filled with water.

In accordance with one or more aspects of the disclosed embodiment, the open fluid passage extends along a longitudinal axis of the buffer assembly.

In accordance with one or more aspects of the disclosed embodiment, reciprocation of the buffer assembly causes a pumping action effecting evacuation of water in one or more of the receiver and the stock configuration receiver extension tube through the buffer assembly.

In accordance with one or more aspects of the disclosed embodiment, the buffer assembly includes a compressible bumper configured to interface with an internal surface of the stock configuration receiver extension tube to effect stopping movement of the bolt carrier away from the receiver.

In accordance with one or more aspects of the disclosed embodiment, the buffer assembly includes a compressible bumper having an aperture that forms part of the open fluid passage.

In accordance with one or more aspects of the disclosed embodiment a portion of the aperture of the compressible bumper includes a tunneling cross-section which funnels water through the stock configuration aperture of the stock configuration receiver extension tube when water head is present in the stock configuration receiver extension tube.

In accordance with one or more aspects of the disclosed embodiment the tunneling cross-section is a frustoparabolic cross-section.

In accordance with one or more aspects of the disclosed embodiment, the buffer assembly includes one or more weights for effecting a predetermined cycling rate of the black rifle.

In accordance with one or more aspects of the disclosed embodiment each weight includes an aperture through which the open fluid passage extends.

In accordance with one or more aspects, of the disclosed embodiment, the buffer assembly includes one or more buffer members disposed between the one or more weights.

In accordance with one or more aspects of the disclosed embodiment each buffer member includes an aperture through which the open fluid passage extends.

In accordance with one or more aspects of the disclosed embodiment, the buffer assembly includes a holding pin that includes an aperture that forms part of the open fluid passage that extends from the interface surface through the buffer assembly.

In accordance with one or more aspects of the disclosed embodiment the buffer assembly includes a body having a longitudinal axis and the holding pin is coupled to the body to extend along the longitudinal axis.

It should be understood that the foregoing description is only illustrative of the exemplary embodiments. Various alternatives and modifications can be devised by those skilled in the art without departing from the exemplary embodiments. Accordingly, the exemplary embodiments are intended to embrace all such alternatives, modifications and variances which fall within the scope of the appended claims.

What is claimed is:

1. A black rifle comprising:

a receiver with a bolt carrier movably located therein;

a receiver extension tube connected to the receiver, the receiver extension tube including an aperture disposed at an end of the receiver extension tube; and a buffer assembly having an interface surface configured to interface with the bolt carrier and being configured to reciprocate through the aperture within the receiver extension tube, the buffer assembly including an open fluid passage which extends from opposing fluid openings in opposing outer ends of the buffer assembly, continuously through the buffer assembly, that is sized and shaped for enabling movement of the bolt carrier relative to the receiver against water at least partially filling the receiver extension tube and effect automatic or semi-automatic fire when the receiver extension tube is at least partially filled with water.

2. The black rifle of claim 1, wherein the open fluid passage extends along a longitudinal axis of the buffer assembly.

3. The black rifle of claim 1, wherein reciprocation of the buffer assembly causes a pumping action effecting evacuation of water in one or more of the receiver and the receiver extension tube through the buffer assembly.

4. The black rifle of claim 1, wherein the buffer assembly includes a compressible bumper configured to interface with an internal surface of the receiver extension tube to effect stopping movement of the bolt carrier away from the receiver.

5. The black rifle of claim 1, wherein the buffer assembly includes a compressible bumper having an aperture that forms part of the open fluid passage.

6. The black rifle of claim 5, wherein a portion of the aperture of the compressible bumper includes a funneling cross-section which funnels water through the aperture of the receiver extension tube when water head is present in the receiver extension tube.

7. The black rifle of claim 6, wherein the funneling cross-section is a frustoparabolic cross-section.

8. A black rifle comprising:

a receiver with a bolt carrier movably located therein;

a stock configuration receiver extension tube connected to the receiver, the stock configuration receiver extension tube including a stock configuration aperture disposed at an end of the stock configuration receiver extension tube; and a buffer assembly having an interface surface configured to interface with the bolt carrier and being configured to reciprocate through the stock configuration aperture within the stock configuration receiver extension tube, the buffer assembly including an open fluid passage which extends from opposing fluid openings in opposing outer ends of the buffer assembly, continuously through the buffer assembly, that is sized and shaped for channeling water and draining the stock configuration receiver extension tube through the stock configuration aperture of the stock configuration receiver extension tube enabling movement of the bolt carrier relative to the receiver against water at least partially filling the stock configuration receiver extension tube and effect automatic or semi-automatic fire when the stock configuration receiver extension tube is at least partially filled with water.

9. The black rifle of claim 8, wherein the open fluid passage extends along a longitudinal axis of the buffer assembly.

10. The black rifle of claim 8, wherein reciprocation of the buffer assembly causes a pumping action effecting evacuation of water in one or more of the receiver and the stock configuration receiver extension tube through the buffer assembly.

11. The black rifle of claim 8, wherein the buffer assembly includes a compressible bumper configured to interface with an internal surface of the stock configuration receiver extension tube to effect stopping movement of the bolt carrier away from the receiver.

12. The black rifle of claim 8, wherein the buffer assembly includes a compressible bumper having an aperture that forms part of the open fluid passage.

13. The black rifle of claim 12, wherein a portion of the aperture of the compressible bumper includes a funneling cross-section which funnels water through the stock configuration aperture of the stock configuration receiver extension tube when water head is present in the stock configuration receiver extension tube.

14. The black rifle of claim 13, wherein the funneling cross-section is a frustoparabolic cross-section.

15. A black rifle comprising:

a stock configuration receiver with a stock configuration bolt carrier movably located therein;

a stock configuration receiver extension tube connected to the stock configuration receiver, the stock configuration receiver extension tube including a stock configuration aperture disposed at an end of the stock configuration receiver extension tube; and a buffer assembly having an interface surface configured to interface with the stock configuration bolt carrier and being configured to reciprocate through the stock configuration aperture within the stock configuration receiver extension tube, the buffer assembly including an open fluid passage which extends from opposing fluid openings in opposing outer ends of the buffer assembly, continuously through the buffer assembly, that is sized and shaped for channeling water and draining the stock configuration receiver extension tube through the stock configuration aperture of the stock configuration receiver extension tube enabling movement of the stock configuration bolt carrier relative to the stock configuration receiver against water at least partially filling the stock configuration receiver extension tube and effect automatic or semiautomatic file when the stock configuration receiver extension tube is at least partially filled with water.

16. The black rifle of claim 15, wherein the open fluid passage extends along a longitudinal axis of the buffer assembly.

17. The black rifle of claim 15, wherein reciprocation of the buffer assembly causes a pumping action effecting evacuation of water in one or more of the stock configuration receiver and the stock configuration receiver extension tube through the buffer assembly.

18. The black rifle of claim 15, wherein the buffer assembly includes a compressible bumper configured to interface with an internal surface of the stock configuration receiver extension tube to effect stopping movement of the stock configuration bolt carrier away from the stock configuration receiver.

19. The black rifle of claim 15, wherein the buffer assembly includes a compressible bumper having an aperture that forms part of the open fluid passage.

20. The black rifle of claim 19, wherein a portion of the aperture of the compressible bumper includes a funneling cross-section which funnels water through the stock configuration aperture of the stock configuration receiver extension tube when water head is present in the stock configuration receiver extension tube.

* * * * *